US012376650B2

(12) United States Patent
Wolfe

(10) Patent No.: US 12,376,650 B2
(45) Date of Patent: Aug. 5, 2025

(54) SELF-WARMING FOOTWEAR

(71) Applicant: Ultimate Warmth, LLC, West Dennis, MA (US)

(72) Inventor: Deborah Eden Wolfe, West Dennis, MA (US)

(73) Assignee: Ultimate Warmth, LLC, West Dennis, MA (US)

( * ) Notice: Subject to any disclaimer, the term of this patent is extended or adjusted under 35 U.S.C. 154(b) by 180 days.

(21) Appl. No.: 18/104,585

(22) Filed: Feb. 1, 2023

(65) Prior Publication Data

US 2023/0248115 A1 Aug. 10, 2023

Related U.S. Application Data

(60) Provisional application No. 63/401,243, filed on Aug. 26, 2022, provisional application No. 63/324,235, filed on Mar. 28, 2022, provisional application No. 63/307,648, filed on Feb. 8, 2022.

(51) Int. Cl.

| | |
|---|---|
| ***A43B 3/00*** | (2022.01) |
| ***A43B 1/00*** | (2006.01) |
| ***A43B 23/08*** | (2006.01) |

(52) U.S. Cl.

CPC ..... *A43B 23/081* (2013.01); *A43B 1/00* (2013.01); *A43B 3/00* (2013.01)

(58) Field of Classification Search

CPC ..... A41B 11/10; A43B 7/34; A43B 23/081; A41D 2400/10; A61F 2/42; A61F 2013/0048

See application file for complete search history.

(56) References Cited

U.S. PATENT DOCUMENTS

| | | | | |
|---|---|---|---|---|
| 6,041,443 | A * | 3/2000 | Pas | A41B 11/005 36/9 R |
| 6,044,497 | A * | 4/2000 | Richardson | A41B 11/10 36/7.4 |
| 6,564,392 | B1 * | 5/2003 | Buckwald | A41B 11/10 2/239 |
| 2006/0073324 | A1 * | 4/2006 | Otto | B32B 5/24 428/305.5 |
| 2011/0203783 | A1 * | 8/2011 | Blackford | D06Q 1/04 165/185 |
| 2012/0054945 | A1 * | 3/2012 | Grubisha | A41B 11/10 2/239 |

(Continued)

FOREIGN PATENT DOCUMENTS

| | | | | |
|---|---|---|---|---|
| WO | WO-2021043447 | A1 * | 3/2021 | D04B 1/16 |

*Primary Examiner* — Jillian K Pierorazio

(74) *Attorney, Agent, or Firm* — Goodwin Procter LLP

(57) ABSTRACT

A toe cap structured and arranged to accommodate toes and a portion of an instep of a wearer and to passively warm the toes and portion of the instep, the toe cap including a first portion having plural layers of a first material (e.g., Mylar®, biaxially-oriented polyethylene terephthalate (BoPET), and combinations thereof) and a second portion having plural layers of the first material and fixedly attached to the first portion, such that an opening for accommodating the wearer's toes and portion of the instep is formed. In some applications the toe cap may also include a second material that is encapsulated between the plural layers of the first portion and/or between the plural layers of the second portion.

10 Claims, 9 Drawing Sheets

(56) References Cited

U.S. PATENT DOCUMENTS

| | | | | |
|---|---|---|---|---|
| 2012/0266492 | A1* | 10/2012 | Youngs | A43B 13/12 428/116 |
| 2017/0231305 | A1* | 8/2017 | Zylstra | A43B 7/34 2/93 |
| 2020/0100927 | A1* | 4/2020 | Eugene | A61F 5/019 |
| 2021/0121321 | A1* | 4/2021 | Burge | A61N 5/0618 |
| 2021/0127787 | A1* | 5/2021 | Baychar | B32B 3/26 |
| 2021/0299996 | A1* | 9/2021 | Conway | B32B 1/00 |
| 2021/0354420 | A1* | 11/2021 | Mihalcik | B32B 5/22 |

* cited by examiner

SELF-WARMING FOOTWEAR

CROSS-REFERENCE TO RELATED APPLICATIONS

This application claims priority to and the benefit of U.S. Provisional Patent Application No. 63/307,648 filed on Feb. 8, 2022, U.S. Provisional Patent Application No. 63/324,235 filed on Mar. 28, 2022, and U.S. Provisional Patent Application No. 63/401,243 filed on Aug. 26, 2022, which are incorporated herein in their entireties.

FIELD OF THE INVENTION

The present invention relates to articles of footwear for warming the toes and forefoot of a wearer and, more particularly, to toe caps that passively retain body heat, further generating additional body heat using captured body heat.

BACKGROUND OF THE INVENTION

Conventional methods for warming appendages, especially toes, have included: thick, winter socks, battery-operated socks, chemically-activated heat pouch inserts, and heat-retaining lotions, which each come with a variety of advantages and disadvantages.

As shown in FIG. 8, toe caps, which, conventionally, are designed to cover—and hence warm—the front part of a wearer's feet, leaving the wearer's heel bare, are configured to protect toes from cold temperatures. Advantageously, toe caps are designed to warm a wearer's toes passively by retaining body heat and generating additional body heat using the captured body heat. Applications for toe caps may include: medical applications, such as to keep toes warm for individuals who suffer from Raynaud's Syndrome, Parkinson's, diabetes, and/or poor circulation; outdoor activities; cold weather sports; for individuals who work outside for long periods of time; and for individuals who work on cold concrete floors for extended periods of time.

The use of neoprene in half socks has been suggested by others. Problematically, neoprene is not an ideal insulator and hence not ideal for heat retention purposes. Practically, neoprene half socks are relatively thick, which makes the half sock noticeable and harder to slide over the wearer's socks and/or to slide into the wearer's footwear. In some instances, the neoprene may be so thick that the wearer's foot no long fits in the article of footwear.

SUMMARY OF THE INVENTION

Accordingly, it would be advantageous to provide a toe cap that provides greater heat retention and insulation passively and, furthermore, that is less noticeable when worn and that is easier to slide over socks and slide into articles of footwear.

In a first aspect, embodiments of the invention relate to a toe cap structured and arranged to accommodate toes and a portion of an instep of a wearer and to passively warm the toes and portion of the instep. In some embodiments, the toe cap includes a first portion comprising plural layers of a first material (e.g., Mylar®, biaxially-oriented polyethylene terephthalate (BoPET), and combinations thereof); a second portion comprising plural layers of the first material and fixedly attached to the first portion, such that an opening for accommodating the wearer's toes and portion of the instep is formed. In some variations, at least one of the first portion and the second portion is about 0.002 mm to about 0.1 mm thick and/or at least one of the first portion and the second portion is about 1.5 mm to about 7 mm thick.

In some applications the toe cap may also include a second material that is encapsulated between the plural layers of the first portion and/or between the plural layers of the second portion. The second material preferably includes an insulating material having a thermal conductivity of about 23 mW/m-K at room temperature and an operating temperature between about −200° C. and about 125° C. with 160° C. peaks (e.g., a silica-based Aerogel, an aerogel blanket, vacuum insulation, or combinations thereof).

In some applications, the plural layers of a first material comprise a single piece of the first material that has been folded over onto itself. Optionally, a temperature-regulating yarn may be woven into the toe cap.

In a second embodiment, the invention relates to a method of manufacturing a toe cap. In some embodiments, the method includes preparing a first portion and a second portion of the toe cap from an amount of a first material (e.g., Mylar, biaxially-oriented polyethylene terephthalate (BoPET), and combinations thereof); and fixedly attaching the first portion and the second portion to one another. In some applications, preparing the first portion and the second portion of the toe cap may include: forming an oblong piece of the first material; folding the oblong piece over onto itself; and fixedly attaching the folded oblong piece to itself.

In some variations, the method may further include incorporating a temperature-regulating yarn woven into the toe cap and/or encapsulating a second material between the folded oblong piece before fixedly attaching the folded oblong piece and second material together. Preferably, the second material comprises an insulating material having a thermal conductivity of about 23 mW/m-K at room temperature and an operating temperature between about −200° C. and about 125° C. with 160° C. peaks (e.g., a silica-based Aerogel, an aerogel blanket, vacuum insulation, or combinations thereof).

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
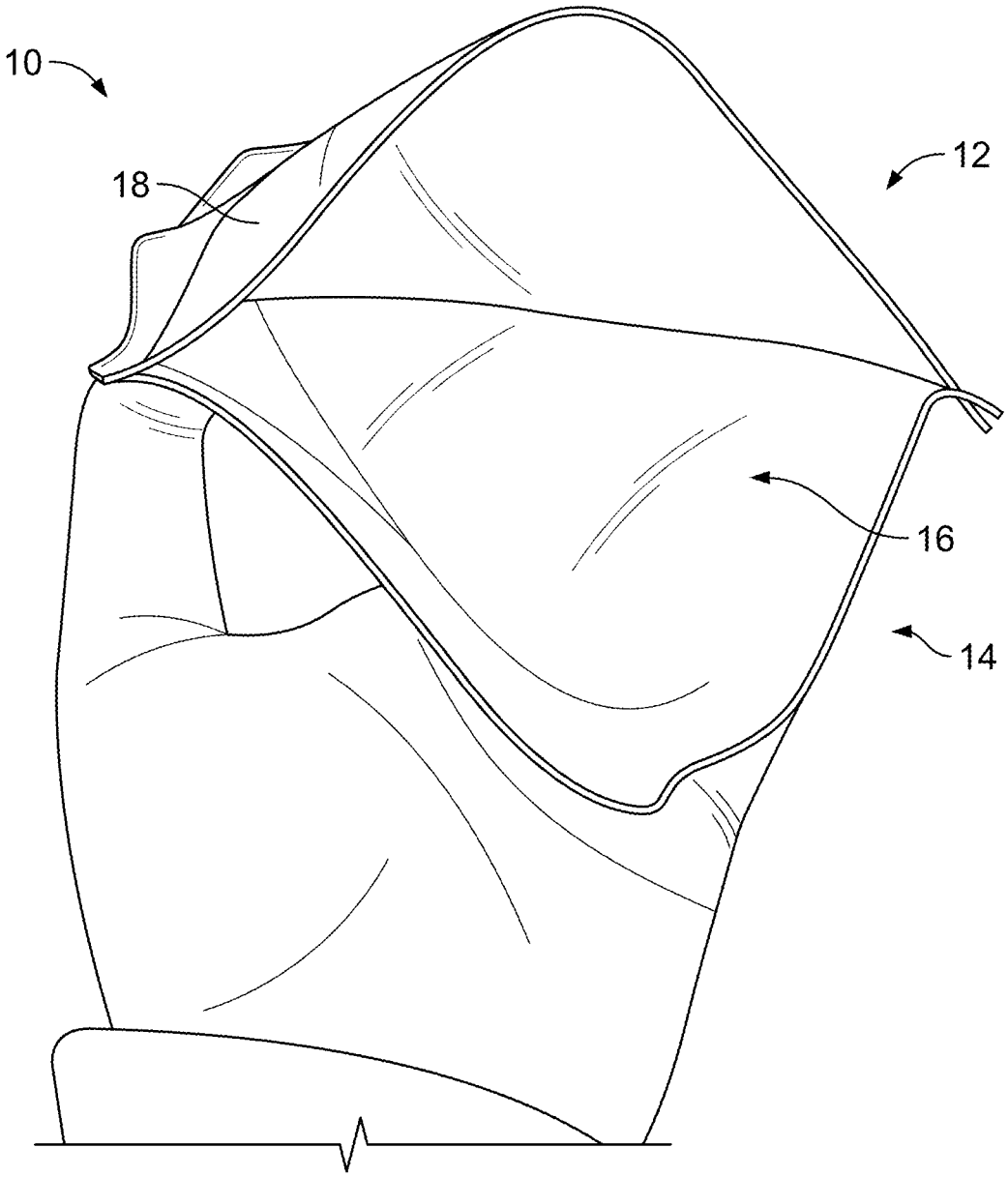
FIG. 1 shows a toe cap, in accordance with a first embodiment of the present invention.
Figure 2:
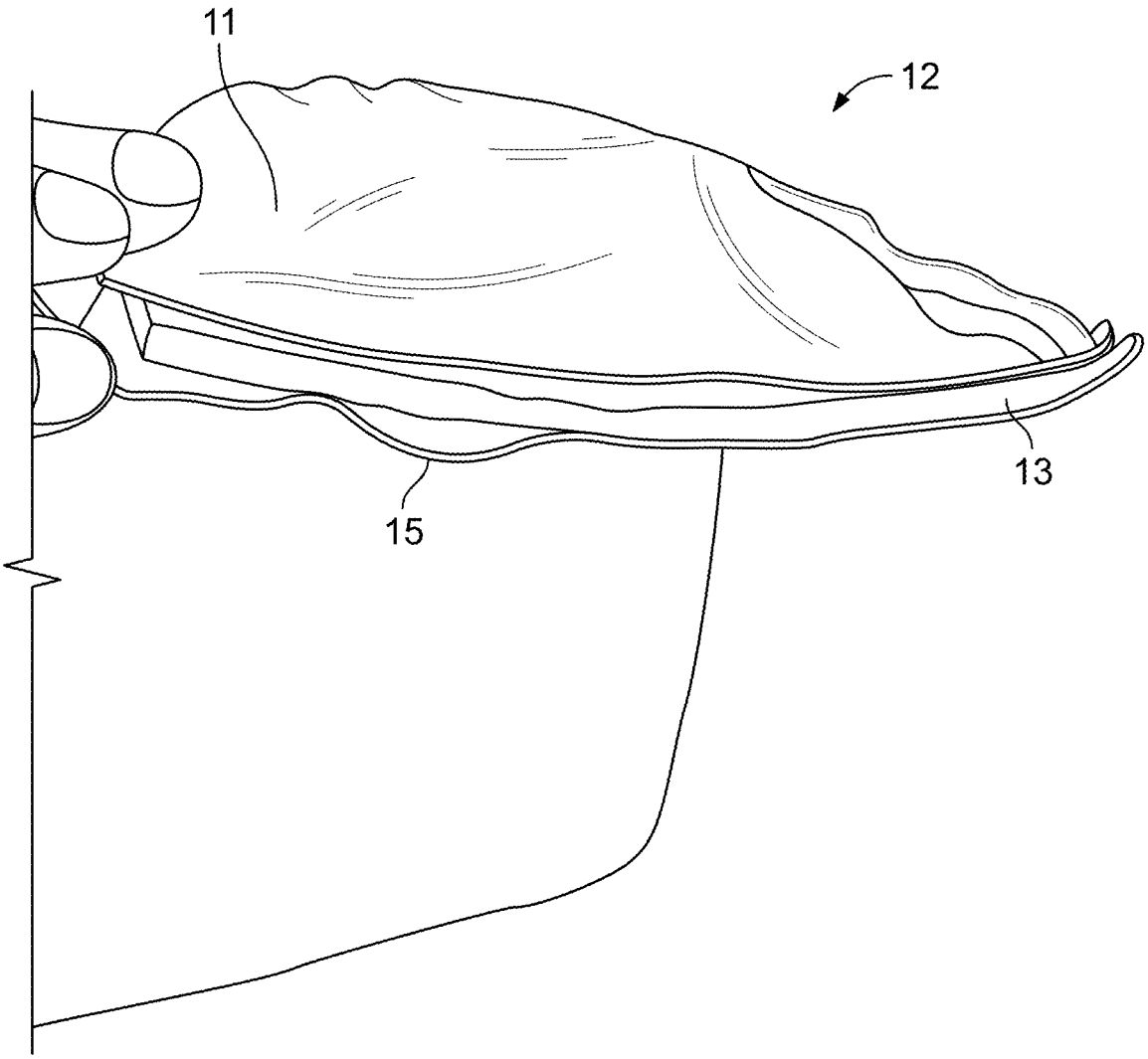
FIG. 2 shows a top or bottom portion of the toe cap of FIG. 1, in accordance with a first embodiment of the present invention.

Referring to FIGS. 1 and 2, a first embodiment of an article of footwear, e.g., a toe cap 10, is shown. Typically, toe caps 10 are structured and arranged to cover the wearer's toes and forefoot, leaving the foot heel open, and are worn as a half-sock shape into which the wearer's foot can slide in and out. Furthermore, the toe caps 10 are manufactured using super-insulators that passively warm the wearer's toes and portion of the instep by retaining body heat and by reflecting body heat back to the body. Advantageously, the toe caps 10 are thin, smooth, durable, lightweight, water-resistant, and easy to slip on and remove from the wearer's foot.

In the first embodiment, each toe cap 10 may be manufactured of a pair of opposing portions 12, 14 that are fixedly attached to one another to define an (e.g., foot) opening 16 therebetween. For example, in some embodiments, a first (i.e., upper) portion 12 and a second (i.e., lower) portion 14 may be fixedly attached to one another by sewing the first (i.e., upper) portion 12 and a second (i.e., lower) portion 14 along the outer perimeter of the half-sock shape, leaving the straight seam 18 open to accommodate the wearer's foot.

In some implementations, each of the first (i.e., upper) portion 12 and second (i.e., lower) portion 14 of the toe cap 10 may include a plurality (e.g., two, two to four, and so forth) layers 11, 15 of a first material that are fixedly attached (e.g., sewn, adhered, heat sealed, and the like) to one another, encapsulating a second material 13 therebetween. Thickness of the first (i.e., upper) portion 12 and/or the second (i.e., lower) portion 14 may range between about 0.002 mm and 0.1 mm. Thickness of the second (e.g., encapsulated) material may range between about 1.5 mm and 6.5 mm.

Preferably, the first material is a super-insulator, e.g., Mylar®, biaxially-oriented polyethylene terephthalate (BoPET), and the like, may be a thin, smooth material that slides easily over other materials (e.g., socks, skin, and so forth) and, moreover, slides easily into footwear (e.g., shoes, boots, hockey skates, ski boots, high-heel boots, and the like).

In some applications, the second material may be an insulating material having an operating temperature between about −200° C. and 125° C. with 160° C. peaks and a thermal conductivity of about 23 mW/m-K at room temperature. Exemplary second materials may include, for the purpose of illustration rather than limitation, silica-based Aerogel, Thermal Wrap™ brand aerogel blankets manufactured by Cabot, vacuum insulation, and the like. Optionally, a temperature-regulating yarn (e.g., Celliant® yarn manufactured by Hollogenix LLC of Pacific Palisades, California may be incorporated into the toe caps 10.

In some variations, each of the first (i.e., upper) portion 12 and second (i.e., lower) portion 14 of the toe cap 10 are configured such that the silver-colored portions (or sides) of the first (e.g., Mylar®) material 11, 15 are disposed towards the encapsulated second (i.e., Aerogel) layer 13, while the orange-colored portions (or sides) of the first (e.g., Mylar®) material 11, 15 are disposed away from encapsulated second (i.e., Aerogel) layer 13.

Advantageously, the toe caps are thin, flexible, and not felt on the foot when they are being worn. In some applications, the total thickness of the toe cap 10, including the top 12 and bottom portions 14 may be about 0.279 inches (in.) or about 7 millimeters (mm).

Figure 3:
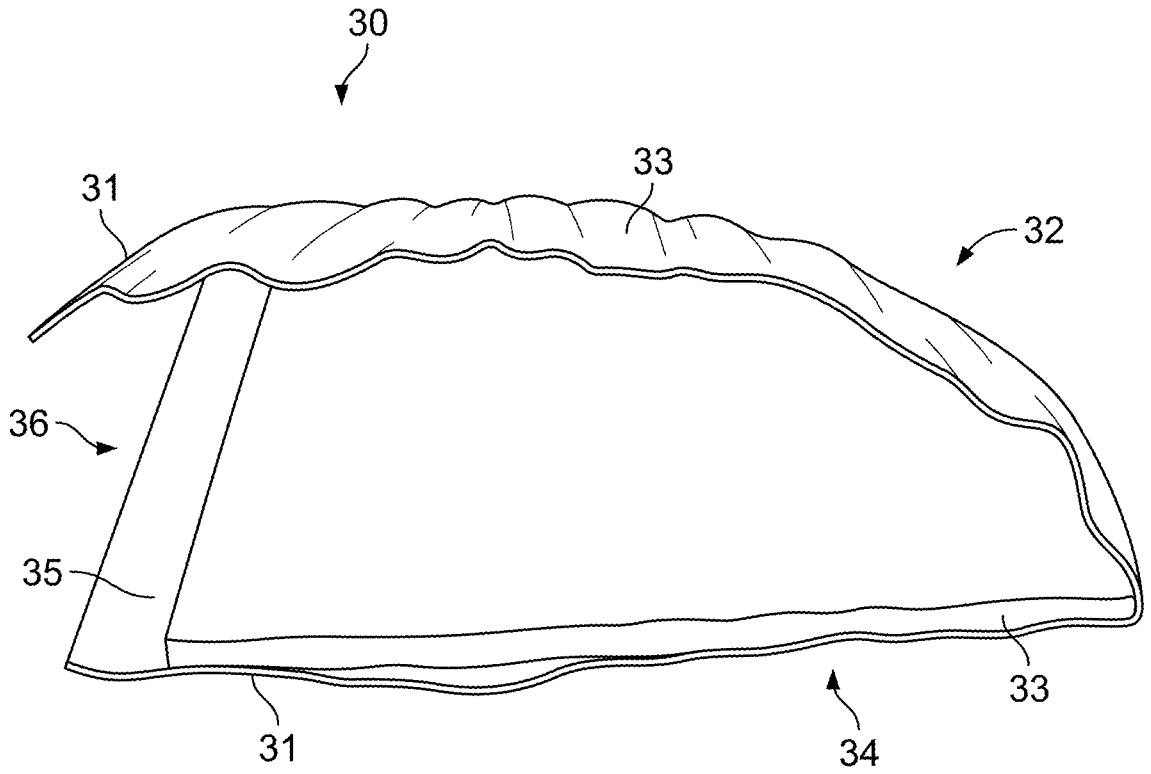
FIG. 3 shows a cross-sectional view of a toe cap, in accordance with a second embodiment of the present invention.
Figure 4:
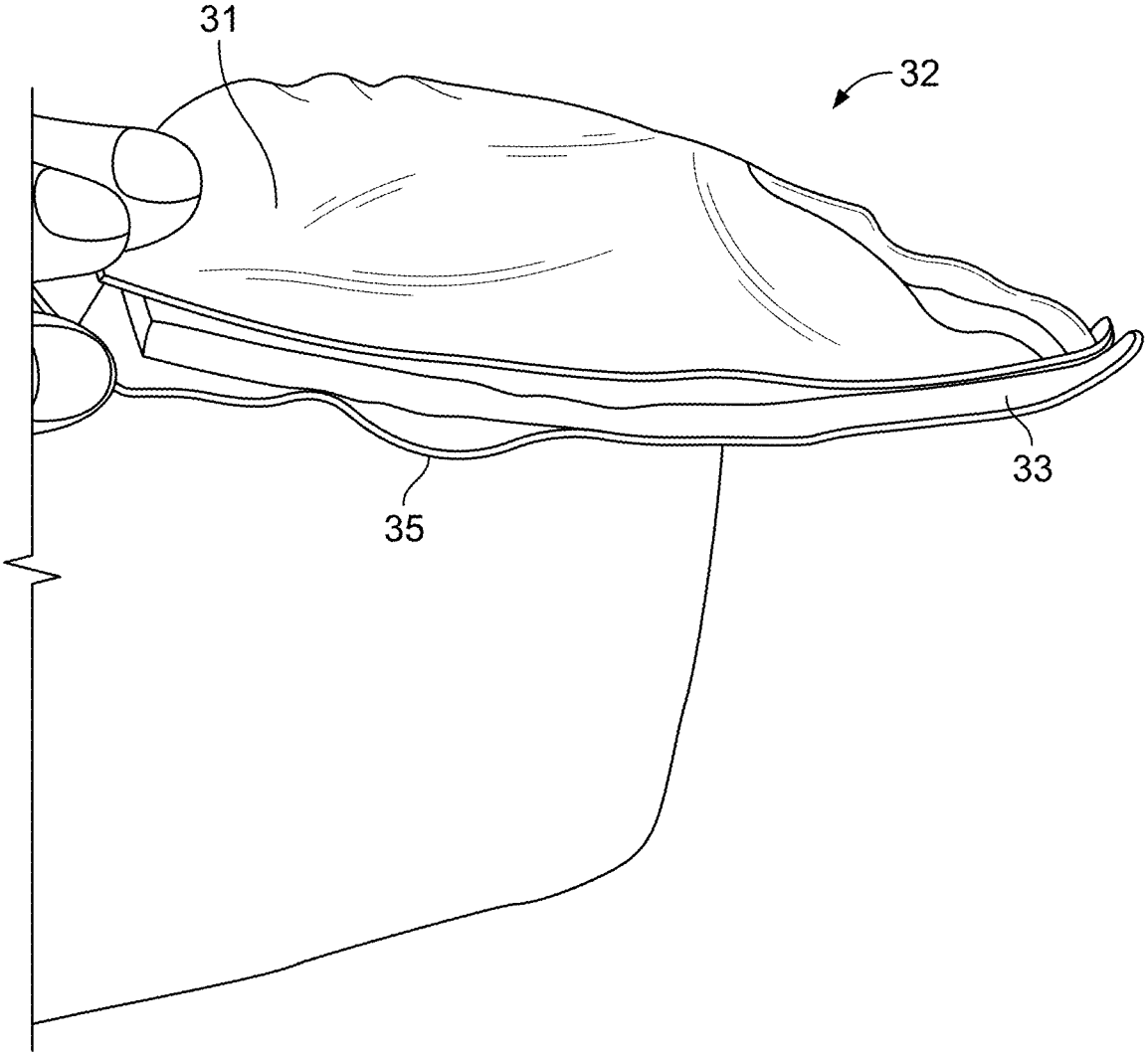
FIG. 4 shows a top or bottom portion of the toe cap of FIG. 3, in accordance with a second embodiment of the present invention.

Referring to FIG. 3 and FIG. 4, a second embodiment of a toe cap 30 for passively warming a wearer's toes and forefoot is shown. As previously described, the toe caps 30 may be adapted to cover the wearer's toes and forefoot, leaving the foot heel open, and may be worn as a half-sock shape into which the wearer's foot can slide in and out.

Advantageously, each toe cap 30 may be manufactured of a pair of opposing portions 32, 34 that are fixedly attached to one another to define an (e.g., foot) opening 36 therebetween. For example, in some embodiments, a first (i.e., upper) portion 32 and a second (i.e., lower) portion 34 may be fixedly attached to one another by sewing the first (i.e., upper) portion 32 and the second (i.e., lower) portion 34 along the outer perimeter of the half-sock shape.

In some implementations, each of the first (i.e., upper) portion 32 and the second (i.e., lower) portion 34 of the toe cap 30 may include a plurality (e.g., two, two to four, and so forth) layers 31, 35 of a first material that are fixedly attached (e.g., sewn, adhered, heat sealed, and the like) to one another. The second (i.e., lower) portion 34 further includes a second material 33 encapsulated between the plurality of layers 31, 35. Thickness of the first (i.e., upper) portion 32 and/or the second (i.e., lower) portion 34 may range between about 0.002 mm and 0.1 mm. Thickness of the second (e.g., encapsulated) material 33 may range between about 1.5 mm and 6.5 mm.

Preferably, the first material, e.g., Mylar®, biaxially-oriented polyethylene terephthalate (BoPET), and the like, may be a thin, smooth material that slides easily over other materials (e.g., socks, skin, and so forth) and, moreover, slides easily into footwear (e.g., shoes, boots, hockey skates, and the like).

In some applications, the second material may be an insulating material having an operating temperature between about −200° C. and 125° C. with 160° C. peaks and a thermal conductivity of about 23 mW/m-K at room temperature. Exemplary second materials may include, for the purpose of illustration rather than limitation, silica-based Aerogel, Thermal Wrap™ brand aerogel blankets manufactured by Cabot, vacuum insulation, and the like. Optionally, a temperature-regulating yarn (e.g., Celliant® yarn manufactured by Hollogenix LLC of Pacific Palisades, California may be incorporated into the toe caps 30.

Figure 5A:
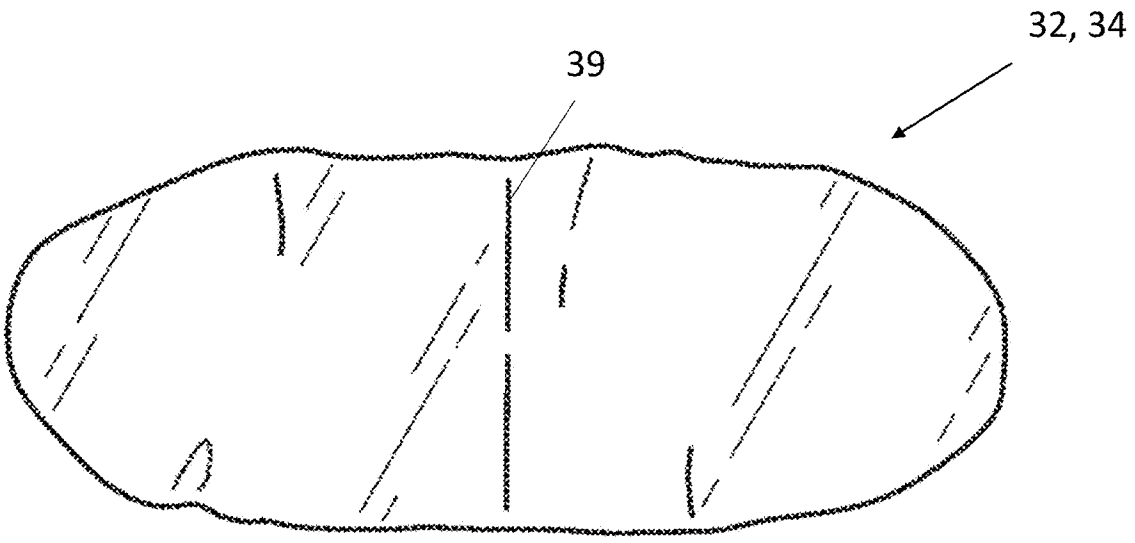
FIG. 5A shows an unfolded oblong piece of a first material for a top of bottom portion of a toe cap, in accordance with some embodiments of the present invention.
Figure 5B:
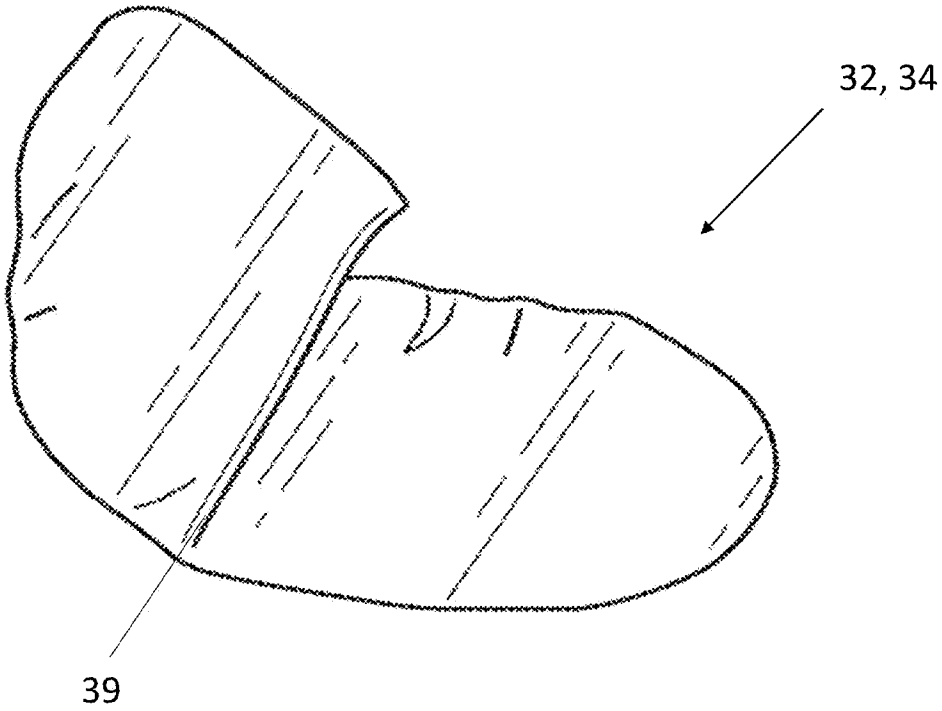
FIG. 5B shows the oblong piece of the first material of FIG. 5A that has been folded, in accordance with some embodiments of the present invention.

In another implementation, as shown in FIGS. 5A and 5B, each of the first (i.e., upper) portion 32 and the second (i.e., lower) portion 34 of the toe cap 30 may be formed from a single (e.g., oblong-shaped) piece of a first material that may be folded about itself along an axis 39 to provide a double thickness of the first material. For example, in some variations, the first (i.e., upper) portion 32 of the toe cap 30 may be configured such that the single (e.g., oblong-shaped) piece of the first material is folded about the axis 39 so that the silver-colored portions (or sides) of the first material are brought together, while the orange-colored portions (or sides) of the first material remain exposed. Optionally, a thin layer of an adhesive, such as, for example, glue, an all-purpose cement glue, a spray adhesive, and the like may be applied to one or both inner (i.e., silver-colored) surfaces of the single (e.g., oblong-shaped) piece of the first material and the folded, glued surfaces pressed together.

For the second (i.e., lower) portion 34, the first material may also be configured such that the single (e.g., oblong-shaped) piece of the first material may be folded about the axis 39, such that the silver-colored portions (or sides) of the first layer 31 and the second layer 35 face one another. The second material 33 may then be placed between the so-formed first layer 31 and second layer 35 and the assembled portions fixedly attached (e.g., sewn, adhered, heat sealed, and the like) to one another, such that the second material 33 is encapsulated between the folded first material in both the first (i.e., upper) portion 32 and the second (i.e., lower) portion 34. Optionally, a thin layer of an adhesive, such as, for example, glue, an all-purpose cement glue, a spray adhesive, and the like may be applied to the second material 33. Once the first (i.e., upper) portion 32 and second (i.e., lower) portion 34, are pressed together, the portions 32, 34 may be fixedly attached (e.g., sewn, adhered, heat sealed, and the like) to one another. Preferably, when the method of attaching is sewing, the portions 32, 34 may be sewn using a single seam of, for example, cotton thread, thin-gauge, nylon, and the like. Due to the folding technique used to prepare each of the portions 32, 34, sewing near the opening 36 for the wearer's foot is not necessary. Advantageously, if the dimensions of the second material 33 are made slightly less than the dimensions of the folded first material 31, 35, then the sewing does not impact the second material.

Advantageously, the toe caps are thin, flexible, and not felt on the foot when they are being worn. In some applications, the total thickness of the toe cap 10, including the top 12 and bottom portions 14 may be about 0.279 in. or about 6.5 mm.

Figure 6B:
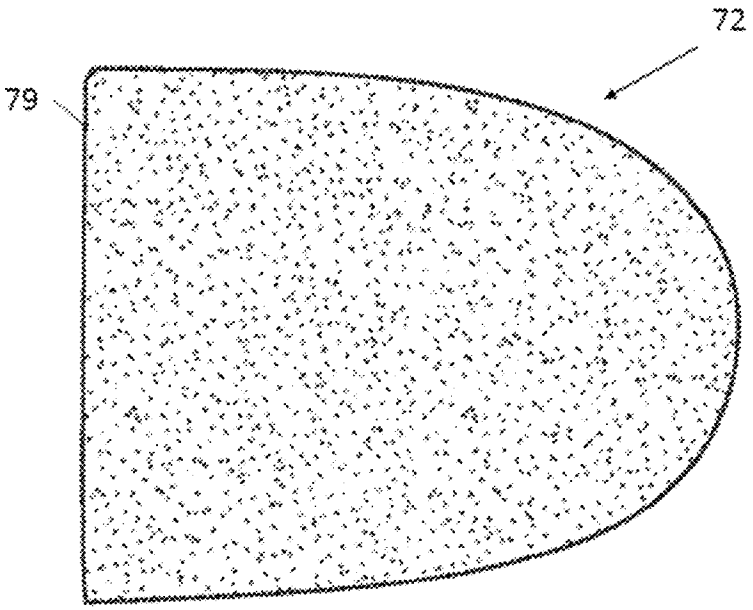
FIG. 6B shows the oblong piece of FIG. 6B that has been folded, in accordance with some embodiments of the present invention.
Figure 6A:
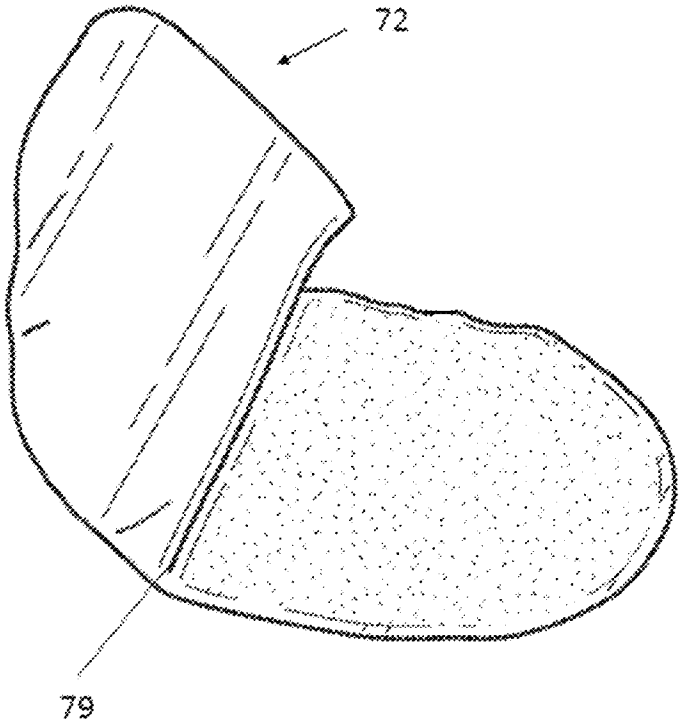
FIG. 6A shows a partially folded oblong piece of a first material for a top of bottom portion of a toe cap, in accordance with some embodiments of the present invention.
Figure 7:
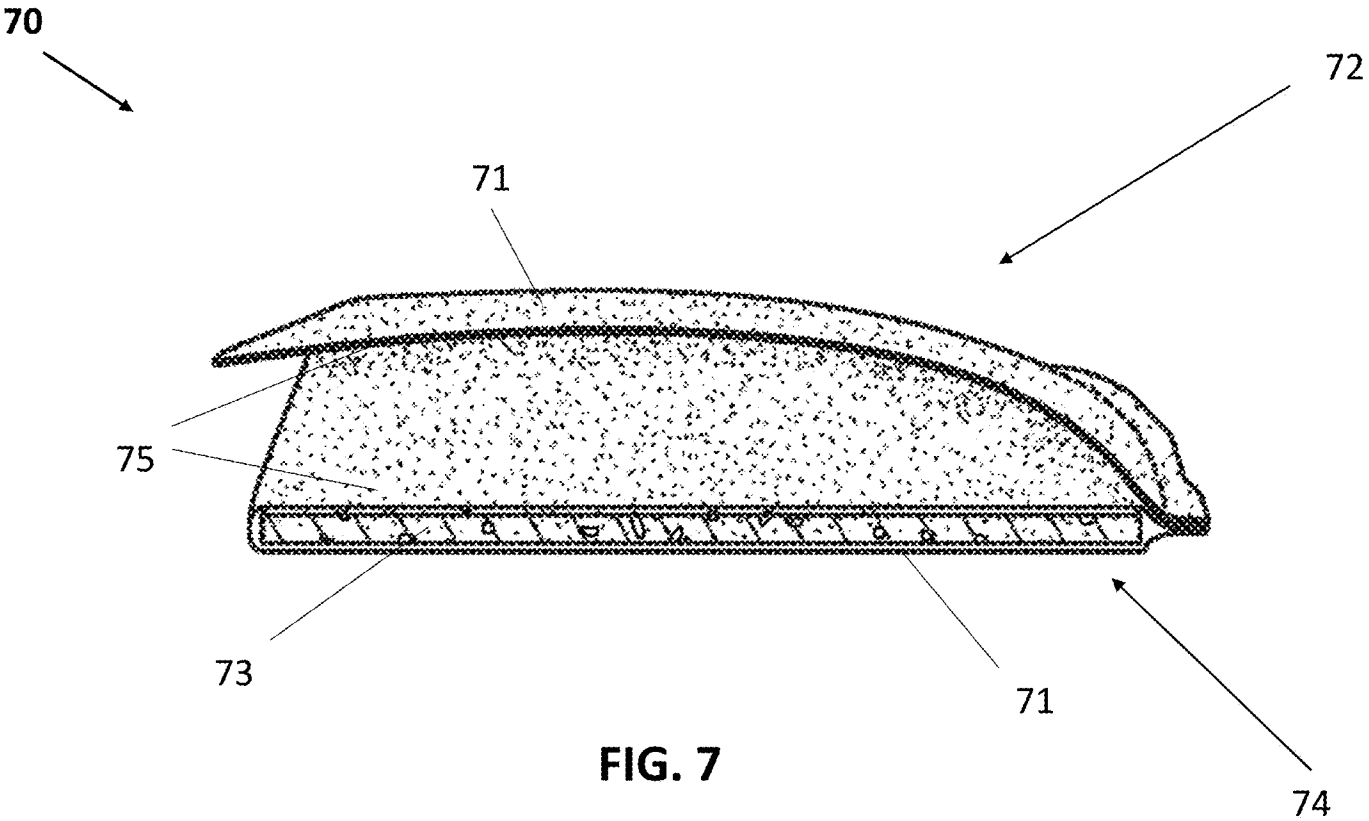
FIG. 7 shows a cross-sectional view of a toe cap, in accordance with a third embodiment of the present invention.
Figure 8:
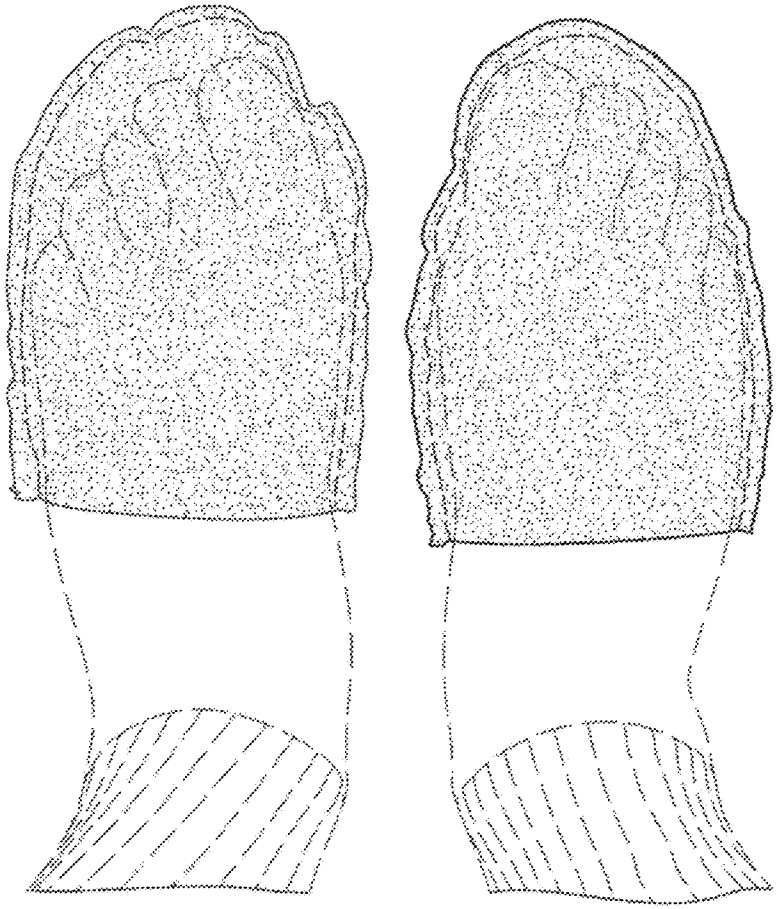
FIG. 8 shows an illustrative example of a pair of toe caps on a wearer's feet, in accordance with some embodiments of the present invention.

In a third embodiment, referring to FIGS. 6A, 6B, and 7, the toe cap 70 may be manufactured of a pair of opposing portions 72, 74 that are fixedly attached to one another to define an (e.g., foot) opening 76 therebetween. For example, in some embodiments, a first (i.e., upper) portion 72 and a second (i.e., lower) portion 74 may be fixedly attached to one another by sewing the first (i.e., upper) portion 72 and the second (i.e., lower) portion 74 along the outer perimeter of the half-sock shape.

In some implementations, each of the first (i.e., upper) portion 72 and the second (i.e., lower) portion 74 of the toe cap 70 may include a plurality (e.g., two, two to four, and so forth) layers 71, 75 of a first material that are fixedly attached (e.g., sewn, adhered, heat sealed, and the like) to one another. A second material is not used in this embodiment. Thickness of the first (i.e., upper) portion 72 and/or the second (i.e., lower) portion 74 may range between about 0.002 mm and 0.1 mm.

Preferably, the first material, e.g., Mylar®, biaxially-oriented polyethylene terephthalate (BoPET), and the like, may be a thin, smooth material that slides easily over other materials (e.g., socks, skin, and so forth) and, moreover, slides easily into footwear (e.g., shoes, boots, hockey skates, and the like). Optionally, a temperature-regulating yarn (e.g., Celliant® yarn manufactured by Hollogenix LLC of Pacific Palisades, Calif. may be incorporated into the toe caps 70.

As shown in FIGS. 6A and 6B, each of the first (i.e., upper) portion 72 and the second (i.e., lower) portion 74 of the toe cap 70 may be formed from a single (e.g., oblong-shaped) piece of a first material that may be folded about itself along an axis 79 to provide a double thickness of the first material. For example, in some variations, the first (i.e., upper) portion 72 and second (i.e., lower) portion 74 of the toe cap 70 may be configured such that the single (e.g., oblong-shaped) piece of the first material is folded about the axis 79 so that the silver-colored portions (or sides) of the first material are brought together, while the orange-colored portions (or sides) of the first material remain exposed. Optionally, a thin layer of an adhesive, such as, for example, glue, an all-purpose cement glue, a spray adhesive, and the like may be applied to one or both inner surfaces of the single (e.g., oblong-shaped) piece of the first material and the folded, glued surfaces pressed together.

The first (i.e., upper) portion 72 and second (i.e., lower) portion 74, may then be fixedly attached (e.g., sewn, adhered, heat sealed, and the like) to one another. Preferably, when the method of attaching is sewing, the portions 72, 74 may be sewn using a single seam of, for example, cotton thread, thin-gauge, nylon, and the like. Due to the folding technique used to prepare each of the portions 72, 74, sewing near the opening 76 for the wearer's foot is not necessary.

Having described various embodiments of a toe cap, methods of manufacturing the toe caps will now be described. In a first step, the first and second portions of the toe cap may be manufactured from, for example, a super-insulator (i.e., first) material such as BoPET, Mylar®, and the like. Preferably, oblong portions of the super-insulator material may be cut from a sheet of the material. Each of the oblong portions may be folded over onto itself and fixedly attached (e.g., adhesively, heat bonded, sewn, and the like) to itself. The first and second portions may then be fixedly attached (e.g., adhesively, heat bonded, sewn, and the like) to one another. For example, the first and second portions may be fixedly attached by sewing the two portions about the periphery of the portions, leaving an unsewn opening between the two portions proximate the folded portion. Optionally, a temperature-regulating yarn may be incorporated into the toe cap and/or used to sew the first and second portions together.

In some variations, before the folded-over oblong portions of the first and/or the second portion are fixedly attached to themselves, a second material, such as silica-based Aerogel, Thermal Wrap™ brand aerogel blankets, vacuum insulation, and the like, may be encapsulated between the folded-over oblong portions of one or both of the first and second portions. The first and second materials may then be fixedly attached to one another and the first and second portions may be fixedly attached to each other.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other steps or stages may be provided, or steps or stages may be eliminated, from the described processes. Accordingly, other implementations are within the scope of the following claims.

What I claim is:

1. A self-warming garment, comprising:

a first portion comprising plural layers of a first material and a second material encapsulated between the plural layers of the first portion, wherein the second material comprises an insulating material having a thermal conductivity of about 23 mW/m-K at room temperature and an operating temperature between about −200° C. and about 125° C. with 160° C. peaks;

a second portion comprising plural layers of the first material and fixedly attached to the first portion, such that an opening for accommodating a wear's body part and portion is formed.

2. The self-warming garment of claim 1, wherein the first material comprises biaxially-oriented polyethylene terephthalate (BoPET).

3. The self-warming garment of claim 1, wherein the second material comprises a silica-based Aerogel, an aerogel blanket, vacuum insulation, or combinations thereof.

4. The self-warming garment of claim 1 further comprising a second material that is encapsulated between the plural layers of the second portion.

5. The self-warming garment of claim 4, wherein the second material comprises an insulating material having a thermal conductivity of about 23 mW/m-K at room temperature and an operating temperature between about −200° C. and about 125° C. with 160° C. peaks.

6. The self-warming garment of claim 4, wherein the second material comprises a silica-based Aerogel, an aerogel blanket, vacuum insulation, or combinations thereof.

7. The self-warming garment of claim 1, wherein the plural layers of a first material comprise a single piece of the first material that has been folded over onto itself.

8. The self-warming garment of claim 1, wherein at least one of the first portion and the second portion is about 0.002 mm to about 0.1 mm thick.

9. The self-warming garment of claim 1, wherein the at least one of the first portion and the second portion is about 1.5 mm to about 6.5 mm thick.

10. The self-warming garment of claim 1 further comprising a temperature-regulating yarn woven into a toe cap, glove, or hat.

* * * * *